US011092144B2

(12) United States Patent
DeBaker

(10) Patent No.: US 11,092,144 B2
(45) Date of Patent: Aug. 17, 2021

(54) PROTECTED AIR INLET FOR AN AIR PUMP WITH A PRESSURE GAUGE

(71) Applicant: Saris Cycling Group, Inc., Madison, WI (US)

(72) Inventor: Chad DeBaker, Minneapolis, MN (US)

(73) Assignee: Saris Cycling Group, Inc., Madison, WI (US)

( * ) Notice: Subject to any disclaimer, the term of this patent is extended or adjusted under 35 U.S.C. 154(b) by 301 days.

(21) Appl. No.: 15/834,530

(22) Filed: Dec. 7, 2017

(65) Prior Publication Data

US 2018/0135611 A1 May 17, 2018

Related U.S. Application Data

(62) Division of application No. 13/903,763, filed on May 28, 2013, now Pat. No. 9,863,409.

(51) Int. Cl.
*F04B 35/01* (2006.01)
*F04B 33/00* (2006.01)

(52) U.S. Cl.
CPC ..... *F04B 35/01* (2013.01); *F04B 33/00* (2013.01); *F04B 33/005* (2013.01)

(58) Field of Classification Search
CPC ..... F04B 35/01; F04B 33/00; F04B 33/005
USPC ..... 417/63, 374
See application file for complete search history.

(56) References Cited

U.S. PATENT DOCUMENTS 577,438 A 2/1897 Lloyd
1,347,434 A * 7/1920 Avery ..... F04B 33/005
1,613,338 A 1/1927 Wepplo
1,737,534 A 11/1929 Davis
5,538,398 A 7/1996 Elson
5,551,848 A 9/1996 Chuang et al.
5,947,706 A 9/1999 Gapinski
6,065,947 A * 5/2000 Wu ..... F04B 25/02 417/526
6,223,907 B1 5/2001 Graber
6,318,969 B1 * 11/2001 Wang ..... F04B 33/00 417/63
6,485,264 B1 * 11/2002 Wu ..... F04B 33/005 417/63
D680,914 S 4/2013 Greenblatt et al.
2002/0174723 A1 * 11/2002 Chuang ..... G01L 19/0007 73/700
2004/0050807 A1 3/2004 Cheng
2005/0121077 A1 6/2005 Chen
2006/0179902 A1 8/2006 Reeves
2010/0163503 A1 7/2010 Kelly
(Continued)

*Primary Examiner* — Essama Omgba
*Assistant Examiner* — Christopher J Brunjes
(74) *Attorney, Agent, or Firm* — Boyle Fredrickson, S.C.

(57) ABSTRACT

An Example can include an elongate pump barrel extending along a length and defining an elongate hollow piston chamber. The Example can include a piston slidably movable within the piston chamber to compress air within the piston chamber. The Example can include a piston rod connected to the piston. The Example can include a handle connected to the piston rod to reciprocally slide the piston in the piston chamber. The Example can include a piston rod seal disposed around the piston rod and coupled with the elongate pump barrel. The Example can include a downward opening air intake passage, located away from the rod seal, in fluid communication with a top of the piston.

6 Claims, 12 Drawing Sheets

(56) References Cited

U.S. PATENT DOCUMENTS

| | | | | |
|---|---|---|---|---|
| 2012/0171053 | A1* | 7/2012 | Wang | F04B 33/005 417/63 |
| 2013/0219705 | A1 | 8/2013 | Scholtz | |

* cited by examiner

PROTECTED AIR INLET FOR AN AIR PUMP WITH A PRESSURE GAUGE

CROSS-REFERENCE TO RELATED APPLICATION

This application is a divisional of U.S. application Ser. No. 13/903,763, filed May 28, 2013.

BACKGROUND

Hand pumps have existed for manual operation in the inflation of various items. Such items include recreational products, but hand pumps have also been used for other purposes such as on tires for automotive vehicles. More commonly, however, hand pumps are used to inflate the tires of bicycles, pneumatic balls and other such recreational items.

Some hand pumps are relatively small and are adapted to be held in one hand and operated with another by reciprocally moving, telescoping or axially aligned components to compress air within a cylinder which is transferred from the cylinder into a valve stem or sealed hole in the article being inflated. Hand operated floor pumps are also well known and typically are larger than the hand held pumps. The hand operated floor pumps are adapted to be placed on a supporting surface and can be held in place with the operator's foot which engages an anchor or pedal on the lower end of the pump.

Hand operated floor pumps typically include an elongated cylindrical barrel having a piston rod with a handle at one end so that the piston rod can be reciprocated relative to the barrel to compress air on alternating strokes. The compressed air can be forced out of an opening in the barrel, which is typically in communication with a flexible hose having a valve head on its terminal end. Valve heads take numerous forms, but are adapted to be connected to valve stems or needles for insertion into sealed openings in pneumatic balls or the like so that the compressed air can be transferred into the article being inflated.

One problem with hand operated floor pumps is that they are not designed for outdoor, public use. Such uses can subject the pump to degradation due to elements, theft and/or tampering. Elements can affect pump performance, such as by seeping into the pump and affecting the performance of internal components. Often, pumps can be carrier away and stolen. Pumps can be tampered with, such as via disassembly and/or abuse such as bending. In order to address to improve public access to pumps, costs should be held to levels that are acceptable to municipalities, such as through the cost reduction of parts, manufacturing, and/or assemblies. Because modern users desire pressure control beyond that which can be sensed by hand such as by pressing on a tire, a pump should allow for precise control of pressure.

BRIEF DESCRIPTION OF THE DRAWINGS

In the drawings, which are not necessarily drawn to scale, like numerals may describe similar components in different views. Numerals having like two-digit numerical suffixes may represent different instances of similar components. The drawings illustrate generally, by way of example, but not by way of limitation, various embodiments discussed in the present document.

FIG. 2F is a back view of the hand pump of FIG. 2A.

FIG. 2G is a left view of the hand pump of FIG. 2A.

FIG. 2H is a top view of the hand pump of FIG. 2A.

FIG. 2I is a bottom view of the hand pump of FIG. 2A.

DETAILED DESCRIPTION

The present subject matter relates to a hand pump and to features to improve the tamper resistance of the hand pump, as well as outdoor performance and longevity of the pump. Examples are useful in public settings, such as by municipalities, to provide bicyclists with a conveniently accessible means of inflating tires, such as when they are away from their homes.

Examples are inexpensive to produce and tamper and weather resistant, offering a long service life. These attributes benefit from a largely seamless exterior. For example, fasteners affixing components to one another are not exposed on the exterior, thereby resisting pump disassembly. Reduced manufacturing complexity can result in lower cost and provide a design that is market competitive.

Figure 1:
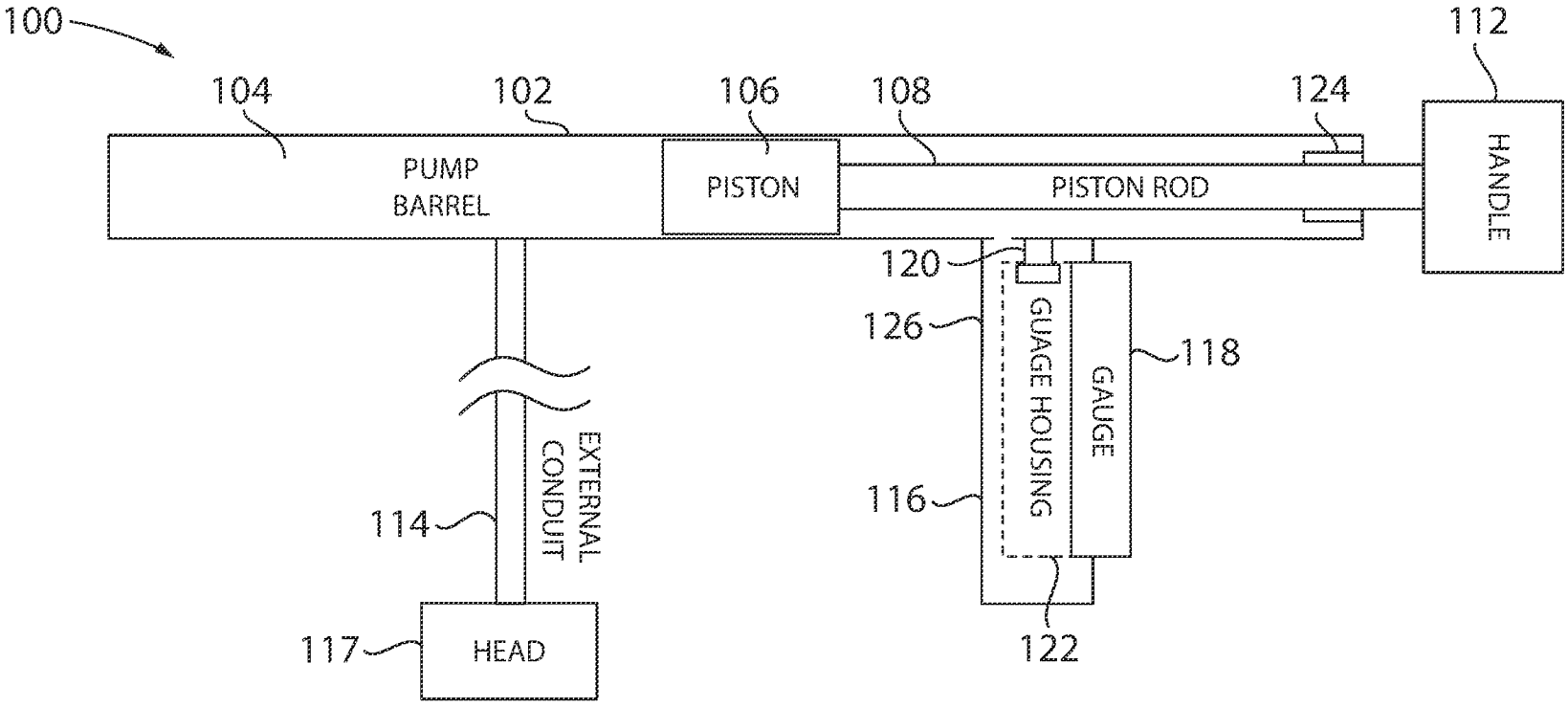
FIG. 1 is a schematic representation of a pump, according to an example.

FIG. 1 is a schematic representation of a pump, according to an example. A pump 100 can include an elongate pump barrel 102. The elongate pump barrel 102 can define an elongate hollow piston chamber 104. A piston 106 can be slidably movable within the piston chamber 104, such as to compress air within the piston chamber 104.

A piston rod 108 can be connected to the piston 106. The piston rod 108 can be sized to resist bending under a load applied by a human user, such as to resist a vandal's attempt to damage the pump. A handle 112 can be connected to the piston rod 108 to reciprocally slide the piston 106 in the piston chamber 104. The handle can have a t-shape, or another shape that is compatible with hand use.

An external conduit 114 such as a pneumatic hose can be coupled with the elongate pump barrel 102. The connection can be direct as illustrated, or can be via a fitting such as a gauge housing 116, as discussed herein by way of several examples. The connection between the external conduit 114 and the elongate pump barrel 102 can be at the top of the pump, or near the bottom, as illustrated.

A head 117 can be connected in fluid communication with the external conduit 114. The head 117 can be adapted to be releasably connected in fluid communication with an inflatable object to transfer compressed air from the piston chamber to the inflatable object. The head 117 can releasably connect to a valve stem, such as a stem compatible with the Schrader, Presta, Dunlop/Woods or Regina standards. The head can include a needle for inflating balls and the like.

A gauge housing 116 can optionally be coupled to the elongate pump barrel 102. A gauge 118, such as a pressure gauge, can be connected to the gauge housing. At least one fastener 120 can couple the gauge housing 116 to the pump barrel 102. The at least one fastener 120 can be disposed between the gauge and the pump barrel 102. The at least one fastener 120 can thus be disposed internal to the gauge housing 116. The gauge 118 can be positioned to interfere with a tool access path 122 to the at least one fastener. Thus, the fastener that couples the gauge housing to the pump barrel 102 is not accessible without removing the gauge 118. The gauge can be held in place with a less common and/or tamper resistant fastener, such as a snap ring, adhesive, welding, brazing, soldering, and the like.

A piston rod seal 124 can be disposed around the piston rod. The piston rod seal can seal against the passage of solids and liquids into the pump barrel 104. An intake opening, such as a downward opening air intake passage 126, can be located away from the rod seal 124, in fluid communication with a top of the piston. The opening can also be shrouded or otherwise protected from the elements. Such a configuration provides that the piston 106 can include a seal only to compress air, and not to both compress air and seal the piston chamber against debris. This can increase pump longevity. Additionally, by positioning the air intake passage 126 as downward opening, accumulation of debris, including solids and liquids, in the intake, can be avoided, versus a conventional approach of air intake around the piston rod 108.

Figure 2A:
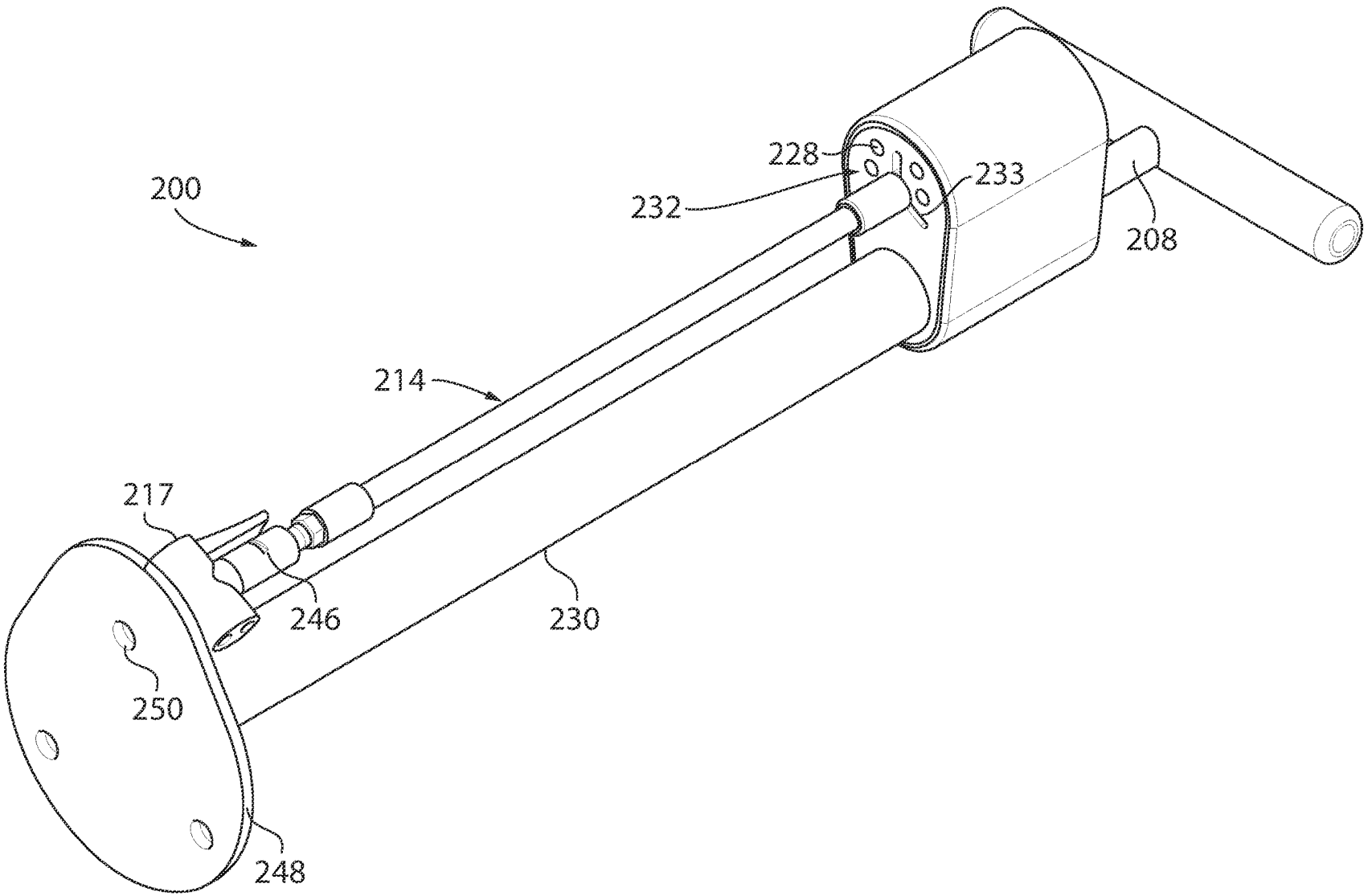
FIG. 2A is a perspective view of a hand pump, according to an example.
Figure 2B:
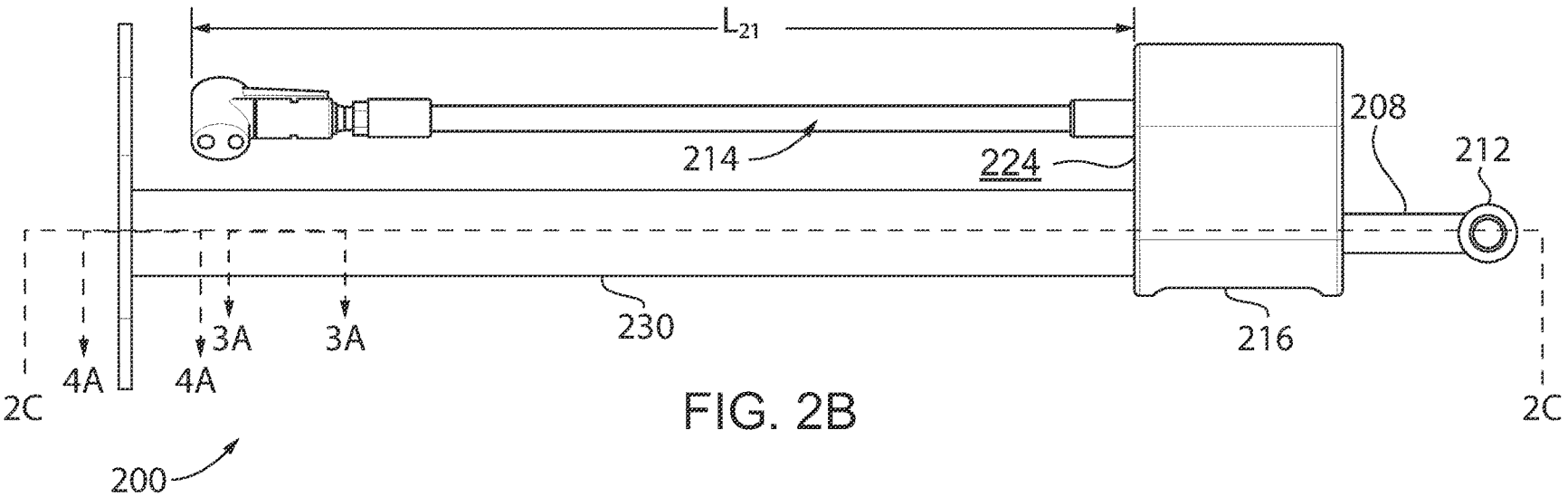
FIG. 2B is a side view of the hand pump of FIG. 2A.
Figure 2C:
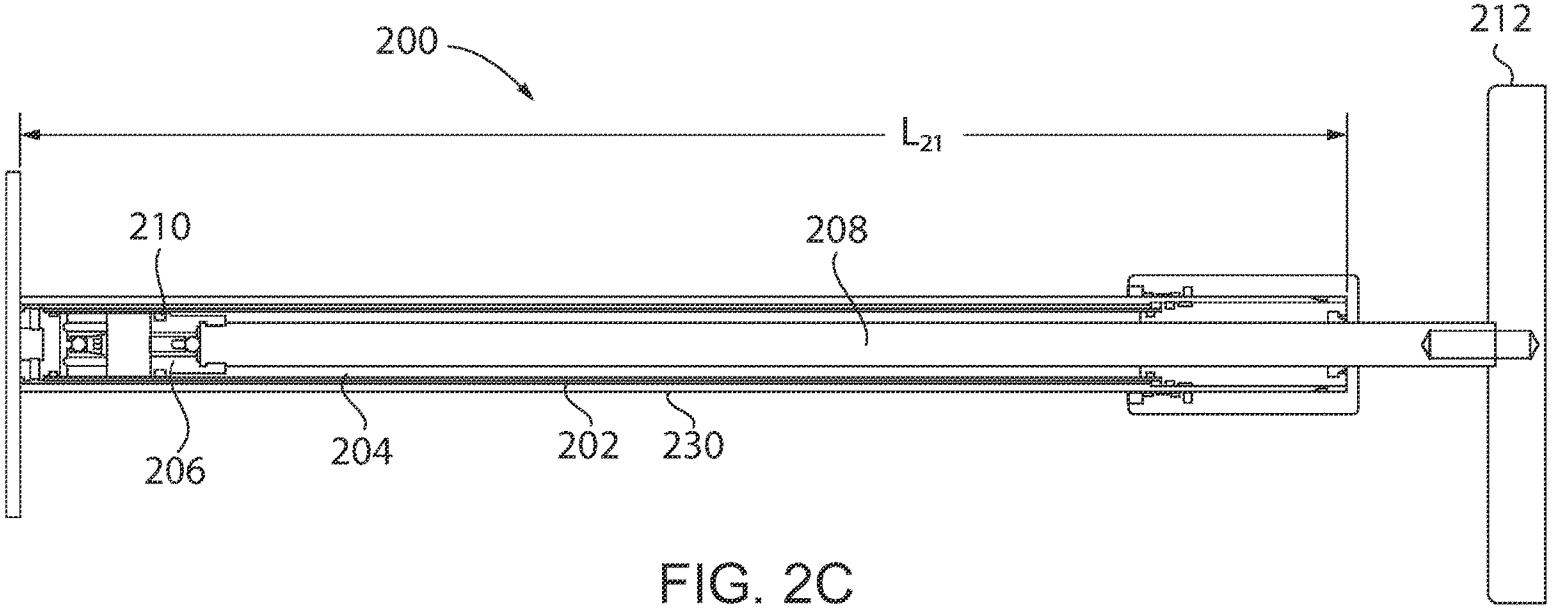
FIG. 2C is a sectional view taken along line 2C-2C in FIG. 2B.

FIGS. 2A-I show views of a hand pump, according to an example. As illustrated in FIG. 2C the pump 200 can include an elongate pump barrel 202 that can extend along a length L21. The piston 206 can be slidably movable within the piston chamber 204, such as to compress air within the piston chamber 204. One or more piston seals 210 (shown in detail in FIGS. 3A-3B) can seal the piston 206 to the elongate pump barrel 202. The piston seals 210 can be shaped to increase sealing force under pressure, such as by including a high-pressure facing portion shaped to direct pump pressure outward toward a seal contact. The seal can have a trapezoidal cross-section with a concavity in the base that is exposed to pump pressure. Returning to FIGS. 2B-C, a handle 212 can be connected to the piston rod 208 to reciprocally slide the piston 206 in the piston chamber 204.

An external conduit 214 can be coupled with the elongate pump barrel 202. The connection can be via a gauge housing 216 as illustrated. A fitting 226 can optionally be disposed in the gauge housing 216. The connection between the external conduit 214 and the elongate pump barrel 202 can be at the top of the pump, as illustrated. As discussed herein, air from an inner chamber 204 can pass through a ball valve into an outer chamber 215, and then into the external conduit through passages in the gauge housing, as described in reference to FIG. 5.

Figure 2D:
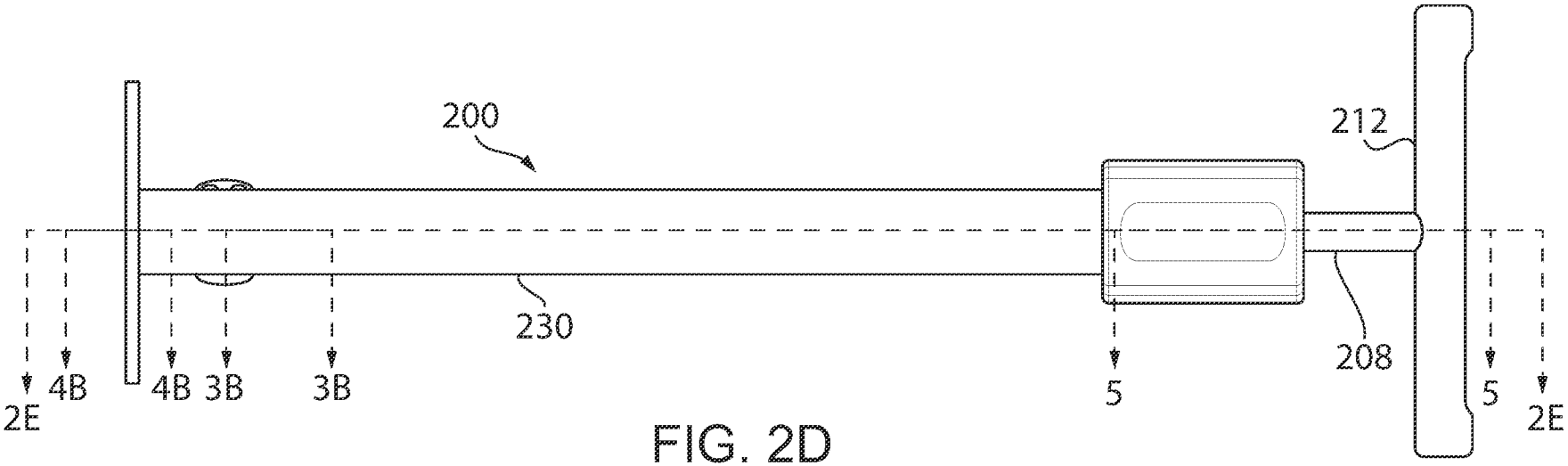
FIG. 2D is a right side view of the hand pump of FIG. 2A.
Figure 5:
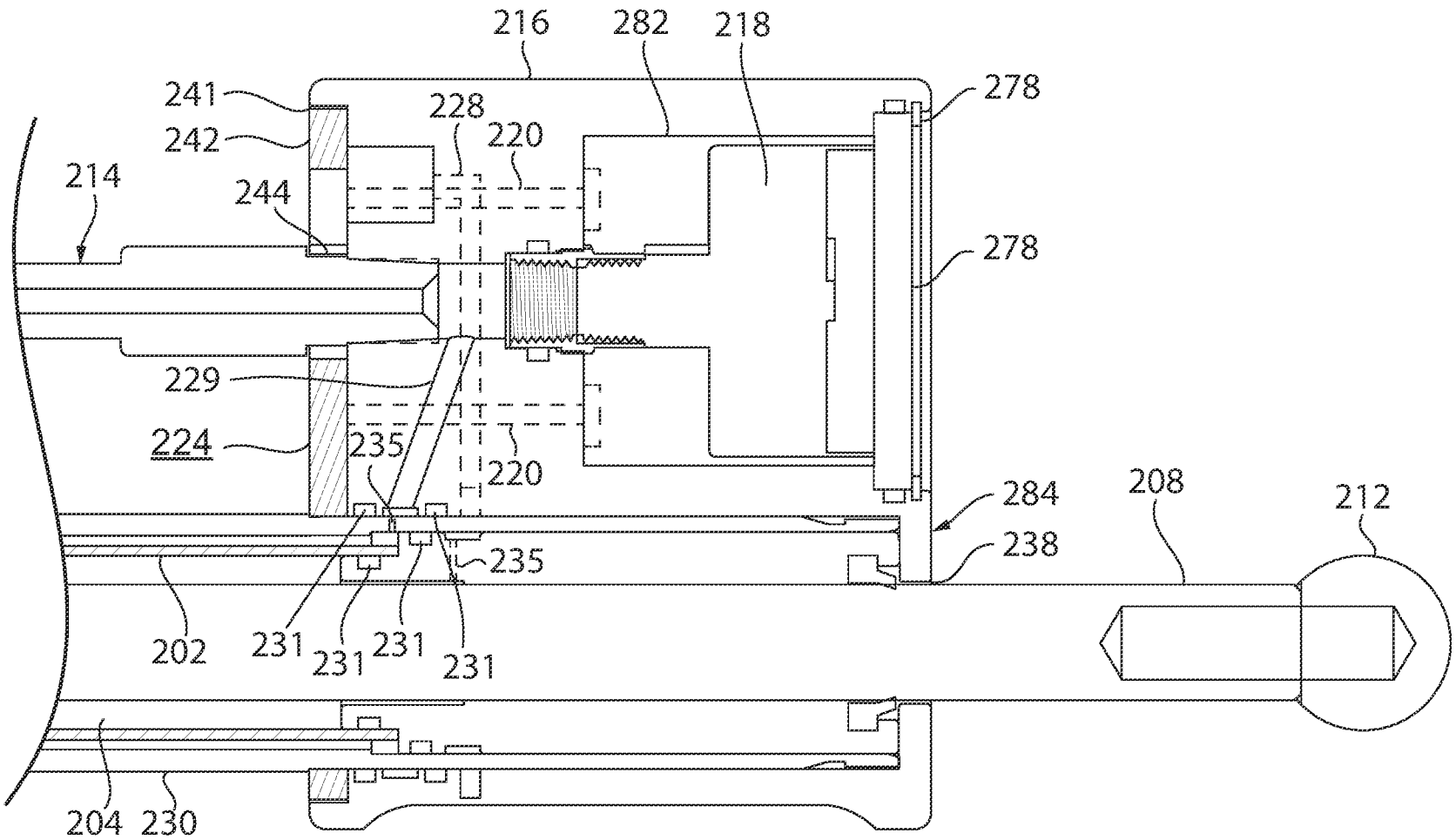
FIG. 5 is a sectional view taken along line 5-5 of FIG. 2D that can be used in various pumps.

FIG. 5 is a sectional view taken along line 5-5 of FIG. 2D that can be used in various pumps. The gauge housing 216 can be coupled to a top of the pump barrel. The gauge housing can define a piston rod opening 238. The piston rod opening 238 can be sized to conform to the piston rod, the piston rod opening being of a diameter that is smaller than a piston diameter of the piston. A seal 240, such as a wiper, can be used to keep debris, water and/or snow out of the chamber 204. The seal 240 can be disposed around the piston rod. The seal can be is disposed inside the gauge housing 216. The seal 240 can be disposed under a top portion 284 of the gauge housing 216, proximal the piston rod opening.

The pump can comprise an elongate pump barrel 202 that is an elongate hollow inner conduit 202, with an elongate hollow outer conduit 230 surrounding the elongate hollow inner conduit 202. The external conduit 214 can be in fluid communication with an elongate hollow outer conduit chamber 215 of the elongate hollow outer conduit 230. The elongate hollow outer conduit 230 can comprise an exterior of the pump. Although the space between the inner and outer conduit is relatively small in the illustration, the present subject matter is not so limited. The elongate hollow outer conduit 230 can be much larger than the elongate hollow inner conduit 202. However, due to the compressibility of air, smaller volume between them can be desirable. However, air restriction can prevent down stroke force. To prevent a rapid velocity of the pump rod which can cause damage to the piston, the pump can have an outlet pressure drop that provides resistance to rapid down stroke velocity.

The elongate hollow outer conduit 230 can include a gauge flange 242. The housing 216 can be coupled to the flange 242 with one or more fasteners 220 that do not form a part of the exterior of the pump. The housing 216 can extend over the gauge flange 242 to position the associated seam 241 along the bottom 224 of the housing.

A fastener 244, such as a hex, for a proximal end of the external conduit 214 can be recessed in the gauge flange 242. Accordingly, in some examples, the external conduit 214 is affixed to the gauge housing 216 before the gauge housing 216 is affixed to the gauge flange 242. Thus the external conduit 214 can be installed into the gauge housing, then the gauge housing can be installed onto the gauge flange 242 which can shroud the hose fitting wrench flats and resist removal of the external conduit 214 once the pump is completely assembled.

The gauge housing 216 can connect to the pump with two separate air signal connections: the inlet 228 and the outlet 229. To facilitate this, the elongate hollow outer conduit 230 can include cross holes 235 that can be sealed, such as with radial O-ring seals disposed in the illustrated lands 231. The outlet 229 can be drilled diagonally to allow machining tool clearance of the gauge housing. The inlet 228 of the pump can open to the bottom 224 of the gauge housing 216, which can shield the inlet 228 from falling debris, rain water, and snow. Contemporary pumps do not include a pressure gauge that shields the inlet. Typical pumps have no rod seal 240 and the inlet air passes by the rod bushing, or the pump outlet is at the bottom of the pump and there is no gauge.

The gauge 218 can be fixed to the gauge housing 216 with a snap ring 280. The gauge housing 216 can define a counterbore 282. The gauge 218 can be disposed in the counterbore. In some examples, the gauge 216 can be disposed entirely in the counterbore. The pump 200 can include a replaceable gauge cover 278. In contemporary approaches, the entire gauge is replaced if the gauge is scratched, rather than replacement of the gauge cover 278 only. The cover 278 can be formed of a transparent material.

Figure 2E:
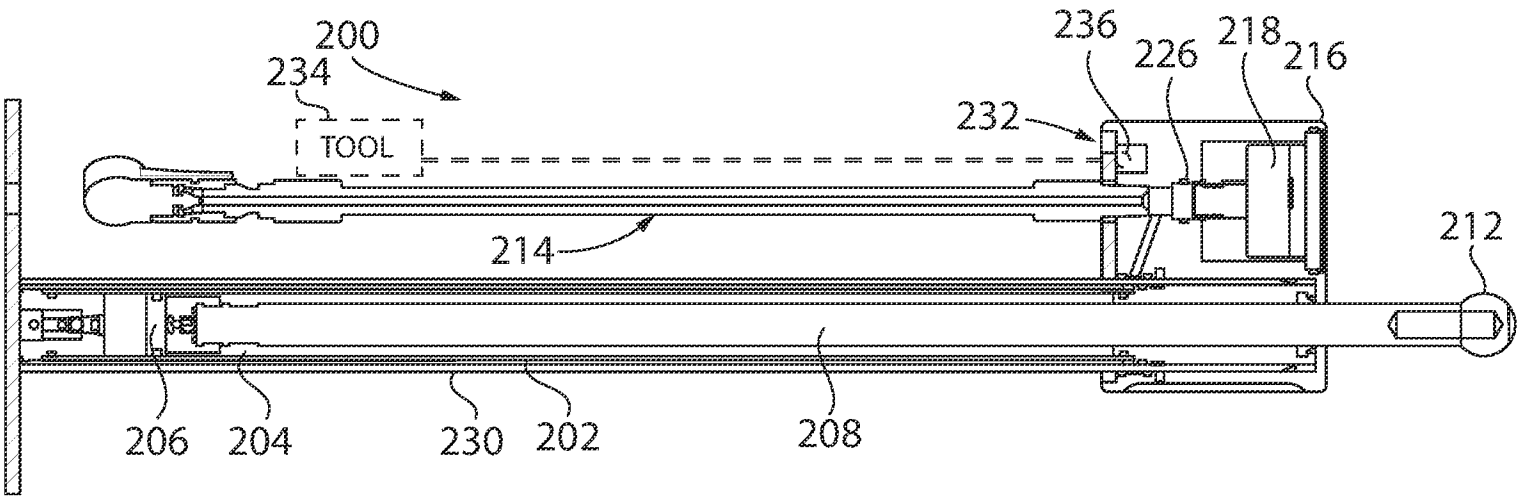
FIG. 2E is a sectional view taken along line 2E-2E in FIG. 2D.

Returning to FIGS. 2A-1, and specifically FIG. 2A and FIG. 2E, the pump 200 can include an integrated tool holder 232 including at least one lanyard opening 233. One or more tools 234 can be affixed to the pump 200, such as by a cable 234. A large anchor 236 can be affixed to the cable 234, such as via crimping, adhesive or metal joining (soldering, brazing, welding). The at least one lanyard opening 233 can be sized to pass the cable but not the anchor 234. Examples of tools include, but are not limited to, tire levers, axle wrenches, allen-key sets, and the like. The gauge flange 240 can form the tool holder, and can define the at least one lanyard opening. The at least one lanyard opening 233 can be a slot.

The external conduit 214 can be coupled to a bottom 224 of the gauge housing 216. The external conduit 214 can extend away from the gauge housing 216 a length L22 that is less than a portion of the length of the elongate pump barrel extending below the gauge housing. The external conduit 214 can be formed of a hydraulic hose which has a metal wire on the inside of a molded rubber exterior. The metal wire can provide strain and cut resistance. The rubber exterior can prevents a metal braid from fraying.

A pump head 217 can be coupled with the external conduit 214 and can be configured to couple with valves of two different sizes. The head 217 can include a relief 246 sized to fit a box end wrench only as wide as a cone wrench. The pump head can use an inexpensive dual valve head. Because the Presta valve system can use a sacrificial rubber seal that can rub against metal threads when it is connected and disconnected, the pump head can be replaceable. To ease maintenance, the valve can be unthreaded. To secure the head, the connection can only be removed with a special size of "cone wrench" that is uncommon.

Examples can include a base 248 coupled to the pump elongate pump and including a plurality of anchor bores 250 to couple with floor anchors.

Figure 3A:
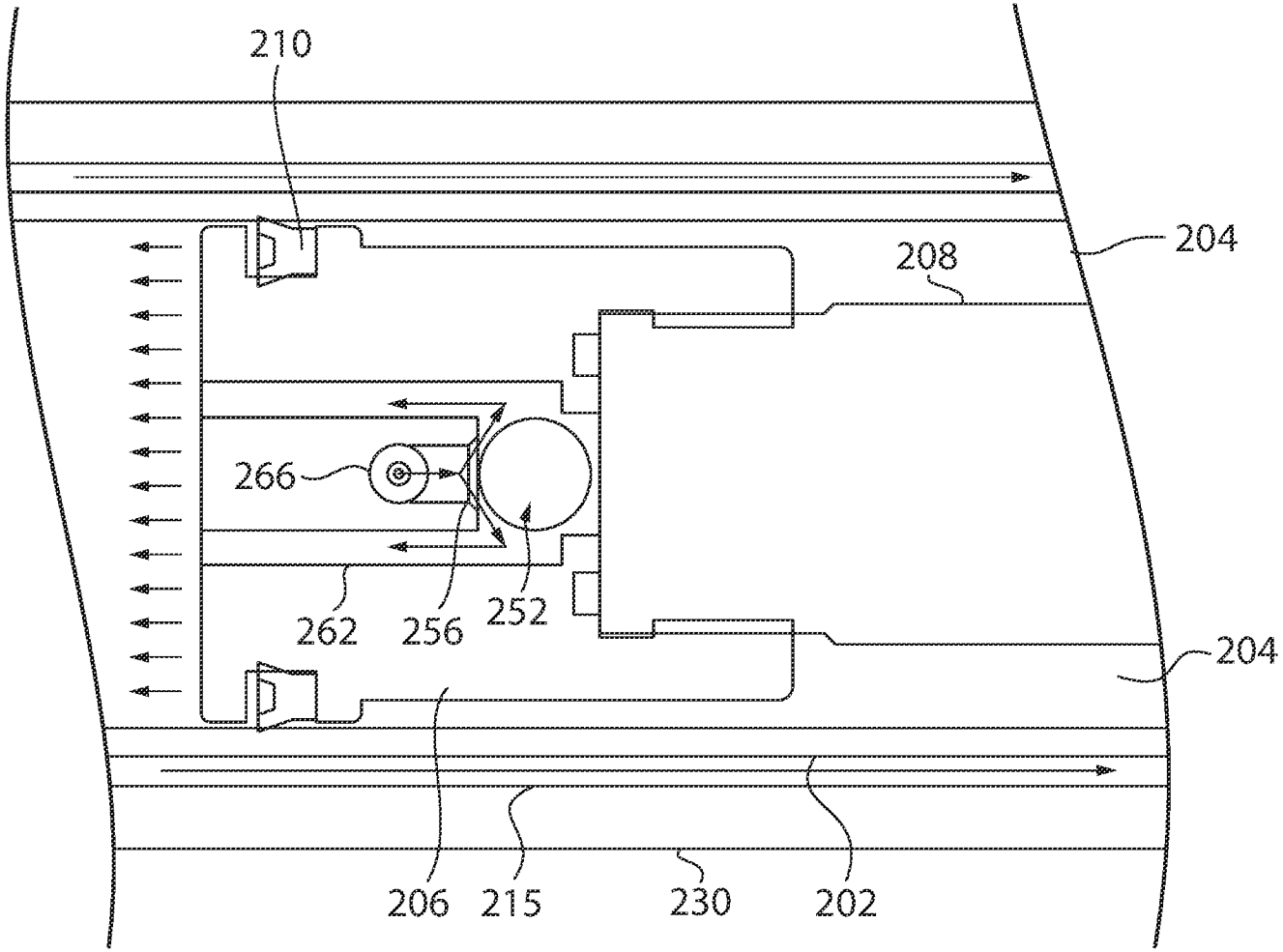
FIG. 3A is a sectional view taken along line 3A-3A of FIG. 2B that can be used in various pumps.
Figure 3B:
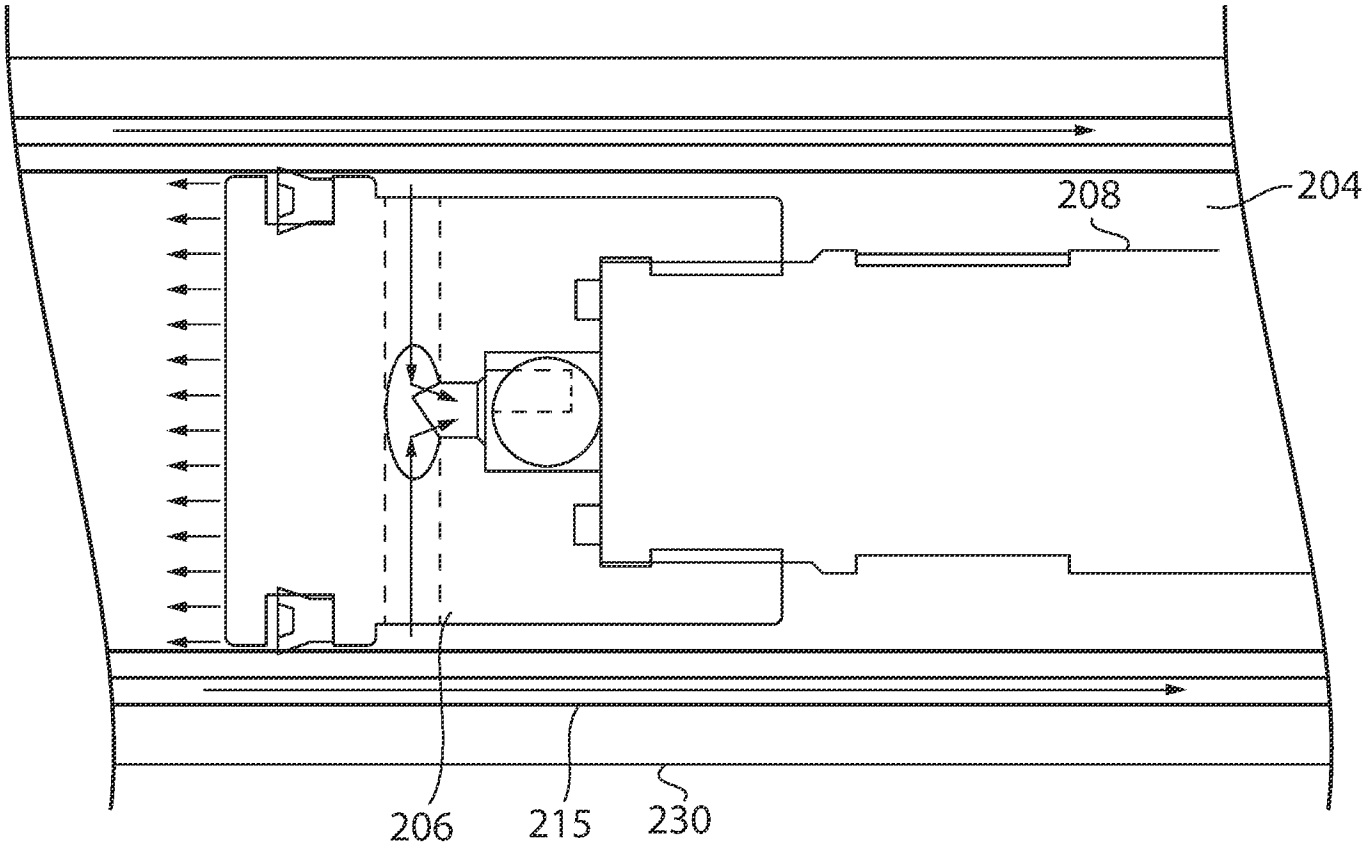
FIG. 3B is a sectional view taken along line 3B-3B of FIG. 2D that can be used in various pumps.

FIG. 3A is a sectional view taken along line 3A-3A of FIG. 2B that can be used in various pumps, FIG. 3B is a sectional view taken along line 3B-3B of FIG. 2D that can be used in various pumps. Any of the views illustrated in FIGS. 3A-B, FIGS. 4A-B, FIG. 5 and FIG. 6 can be used alone or in combination with any of the pumps contemplated by this disclosure.

Pump examples can include a piston 206 that incorporates a ball check valve 252. The valve can utilize gravity to quickly check pressure, even with debris present, as debris can fall out of the check. Pressure and gravity can function to ensure the check stays closed to maintain pressure. Thus, the piston seal can function separately from the check valve. Contemporary pumps utilize a seal that has an integral check using a special molded seal or an O-ring. By separating the check function from the seal, examples allow the use of an industrial U-cup that can provide longer life.

A first ball valve seat 256 can be below a first ball valve ball 258. A first ball valve inlet passage 260 can extend transverse to the length L22 of the elongate pump housing. A first ball valve outlet passage 262 can extend parallel the length. L22. The first ball valve outlet passage 262 can be one of a pair of outlet passages extending on two sides of the first ball valve inlet passage.

Figure 4A:
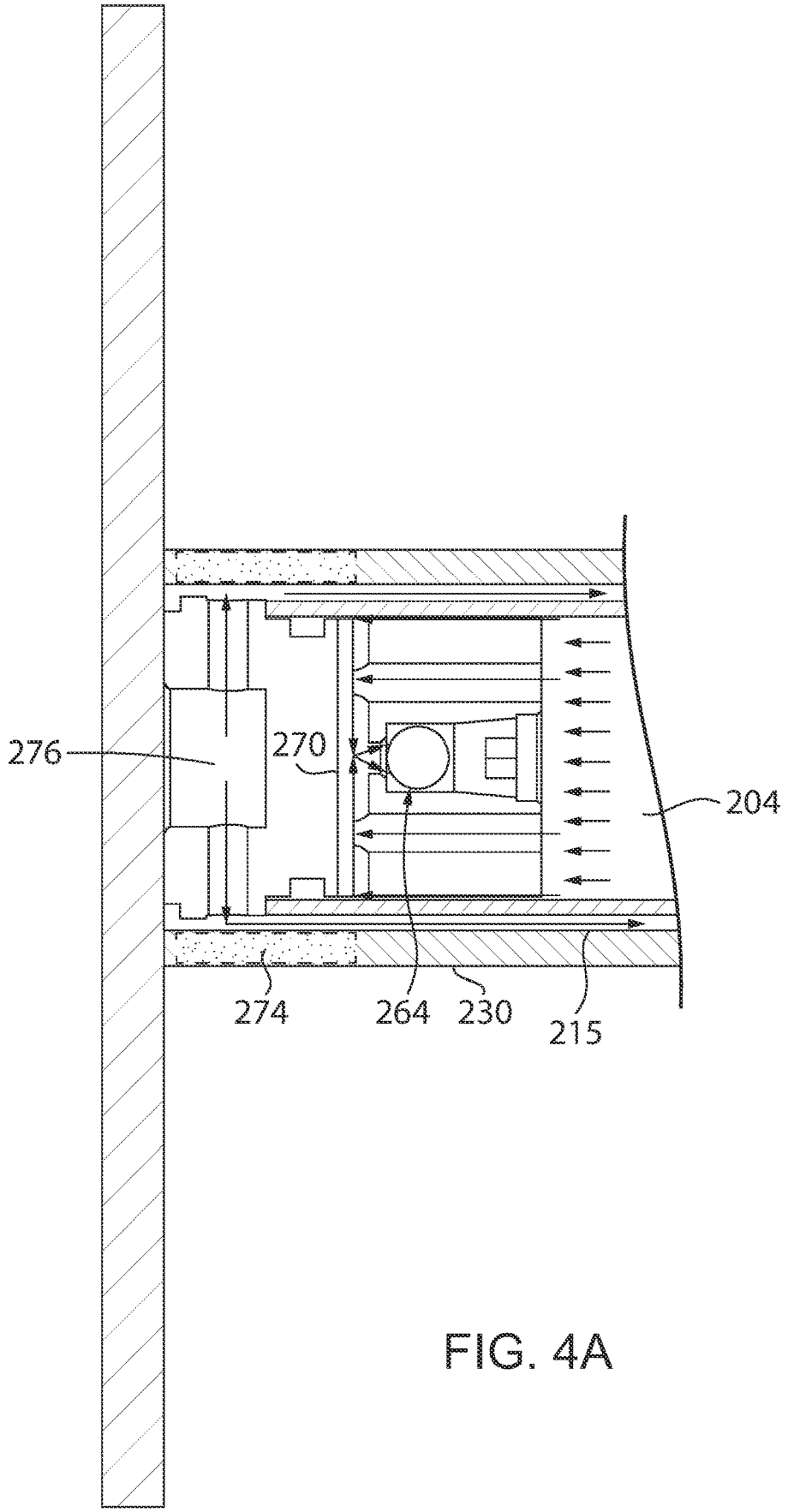
FIG. 4A is a sectional view taken along line 4A-4A of FIG. 2B that can be used in various pumps.
Figure 4B:
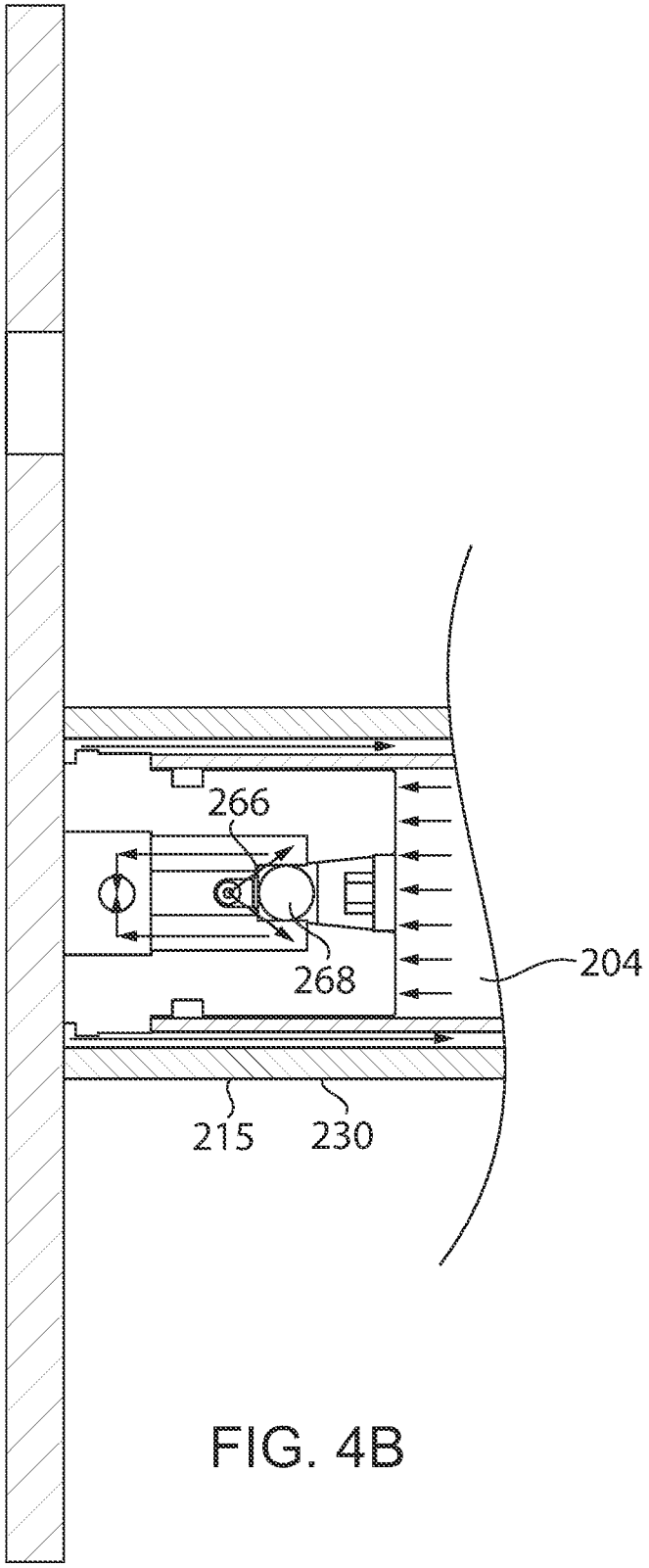
FIG. 4B is a sectional view taken along line 4B-4B of FIG. 2D that can be used in various pumps.

FIG. 4A is a sectional view taken along line 4A-4A of FIG. 2B that can be used in various pumps. FIG. 4B is a sectional view taken along line 4B-4B of FIG. 2D that can be used in various pumps. A second ball valve 264 can be coupled to the elongate piston chamber to pass air from the elongate hollow piston chamber 204 to the external conduit chamber 215. A second ball valve seat 266 can be disposed above a second ball valve ball 268. A second ball valve inlet passage 270 can extend transverse to the length L22 of the elongate pump housing. A second ball valve outlet passage 272 can extend parallel the length L22 of the elongate pump housing. The second ball valve outlet passage 272 can be one of a pair of outlet passages extending on two sides of the second ball valve inlet passage 270.

The second valve, or foot valve, illustrated in FIGS. 4A-B can use the same type of check valve as the piston check valve illustrated in FIGS. 3A-B. It can also use gravity and pressure to quickly close the check valve. The passages can reverse the air flow direction inside the foot valve such that airflow is toward the handle 212. The outlet passage can defines a catch basin 276 to catch debris.

A dessicant 274 can be disposed between the inner conduit and the outer conduit. The dessicant 274 can be formed of a replaceable cartridge that is annular and surrounds the elongate pump barrel.

Figure 6:
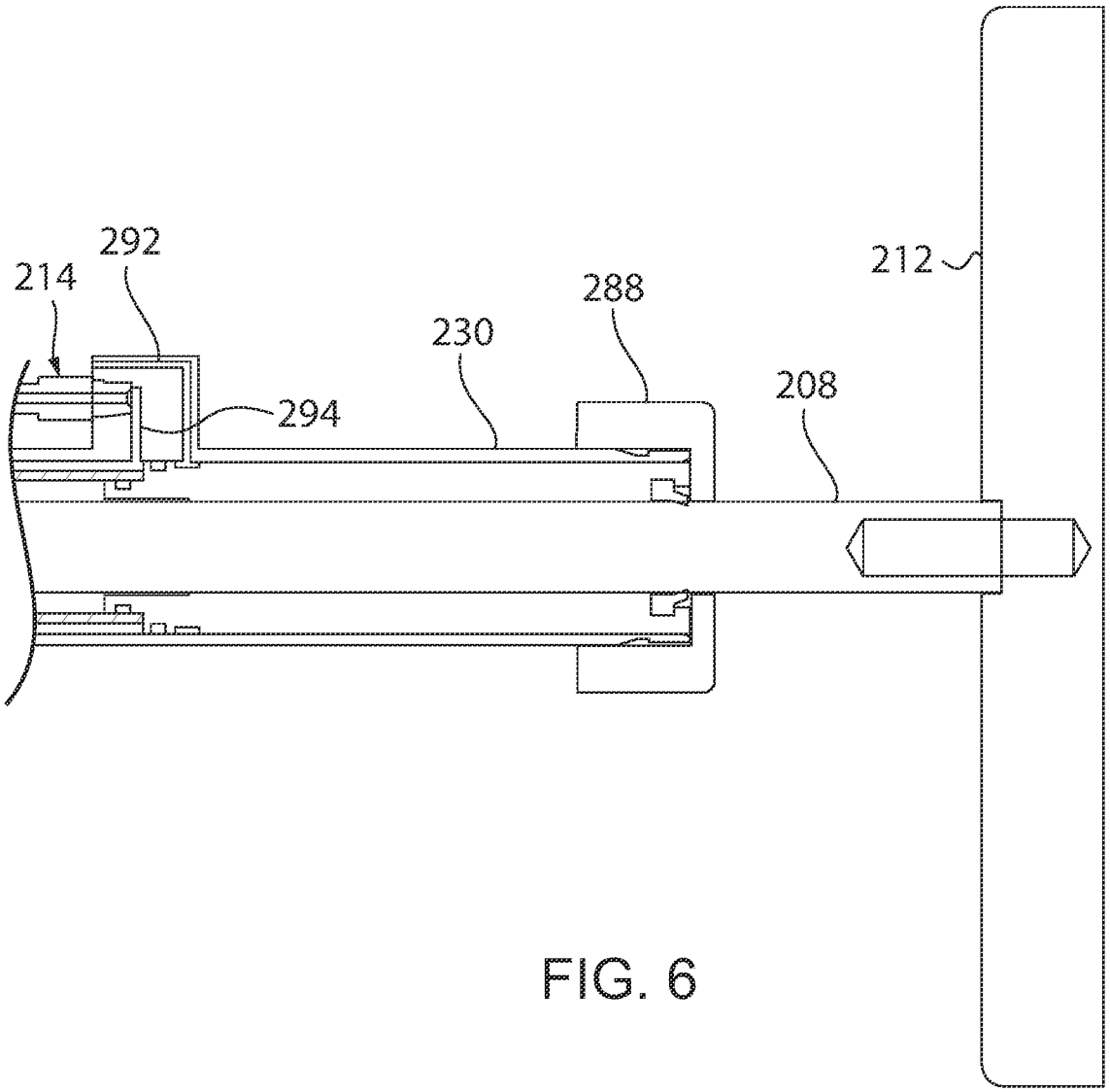
FIG. 6 is a sectional view of a hand pump without a top-mount gauge, according to an example.

FIG. 6 is a sectional view of a hand pump without a top-mount gauge, according to an example. In some examples, the elongate hollow outer conduit 230 can be threaded, to threadingly couple with a cap 288 defining an opening sized to conform to the piston rod. An external conduit coupling 290 can be coupled to the elongate hollow outer conduit 230 and can include an inlet passage 292 and an outlet passage 294. Thus, the same elongate hollow outer conduit 230 can be used for a gauged embodiment and an embodiment with no gauge, or a remote gauge such as one coupled to the external conduit 214.

Figure 7:
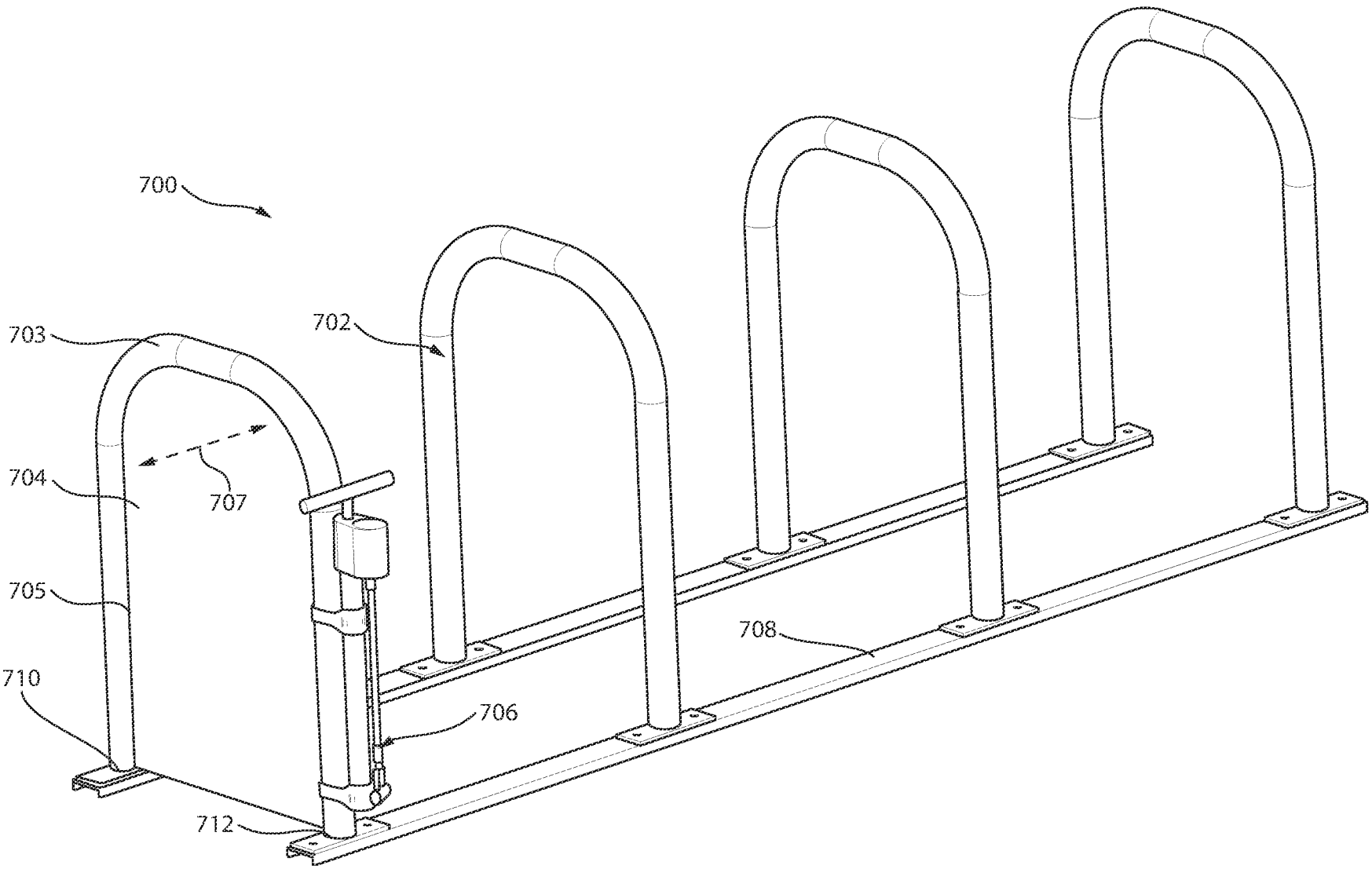
FIG. 7 is a perspective view of a rack including a pump, according to an example.

FIG. 7 is a perspective view of a rack 700 including a pump 706, according to an example. The rack 700 can include a plurality of rack members 702. At least one of the rack members can includes an elongate portion 703. The elongate portion can define a shape 705. A sheet 704, such as a planar sheet such as a plate, can be affixed to the elongate portion 703. The sheet 704 can substantially fill the shape 705, such as to interfere with passage of a bicycle lock through 707 the shape. The shape 705 can be an inverted U-shape as illustrated.

Two ends 710, 712 can be affixed to a substrate, such as a cement slab, or to another substrate. One or more of the plurality of rack members can define an inverted U-shape as illustrated, with the U-shape opening in the negative Y-direction as illustrated. A first respective end (including 710) of each of the rack members coupled to a first strut 714 that extends transverse (in the Z-direction) to the U-shape. A second respective end (including 712) of each of the rack members coupled to a second strut 716 that extends parallel the first strut. The second respective end can be alongside the first respective end in the X-direction, with the U-shape being disposed in the X-Y plane.

Figure 8:
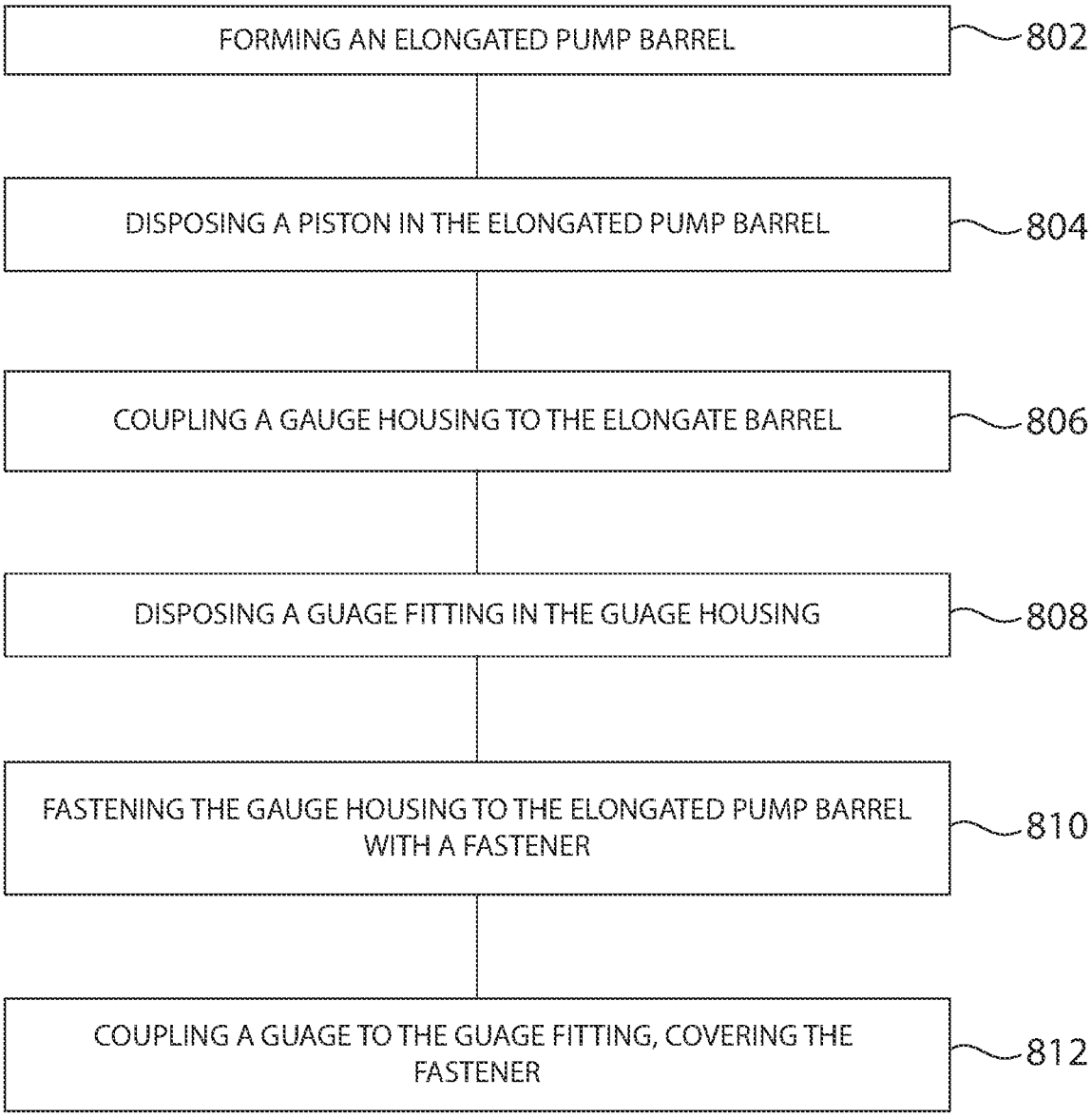
FIG. 8 is a method of making a hand pump, according to an example.

FIG. 8 is a method of making a hand pump, according to an example. At 802, the method can include forming an elongate pump barrel. The method can include forming a barrel that extends along a length to define an elongate hollow piston chamber. At 804, the method can include disposing a piston in the elongate barrel. The piston can be disposed in a piston chamber, slideable for compressing air within the piston chamber. The method can include coupling a piston rod to the piston, and a handle connected to the piston rod for reciprocally sliding the piston in the piston chamber. The method can include coupling an external conduit to the elongate pump barrel. The method can include coupling a head in fluid communication with the conduit for releasably connecting in fluid communication with an inflatable object and transferring compressed air from the piston chamber to the inflatable object. At 806, the method can include coupling a gauge housing to the elongate barrel. At 808, a gauge fitting can be coupled to the gauge housing. At 810, the method can include fastening the gauge housing to the pump barrel with a fastener. At 812, a gauge can gauge can be affixed to the barrel, covering the at least one fastener.

The fastener can be disposed under the gauge between the gauge and the pump barrel, internal to the gauge housing, with the gauge positioned to interfere with a tool access path to the at least one fastener.

Method examples can include coupling the external conduit to the gauge housing before coupling the gauge housing to the elongate conduit. Examples can include recessing a fastener coupling the external conduit to the gauge housing within the external conduit, such as within a gauge flange, to prevent disassembly of the external conduit from the pump.

NOTES AND EXAMPLES

Example 1 can include, or can optionally be combined with the subject matter of the preceding examples, comprising an elongate pump barrel extending along a length and defining an elongate hollow piston chamber. The Example can include a piston slidably movable within the piston chamber to compress air within the piston chamber. The Example can include a piston rod connected to the piston. The Example can include a handle connected to the piston rod to reciprocally slide the piston in the piston chamber. The Example can include an external conduit coupled with the elongate pump barrel. The Example can include a head connected in fluid communication with the conduit and adapted to be releasably connected in fluid communication with an inflatable object to transfer compressed air from the piston chamber to the inflatable object. The Example can include a piston rod seal disposed around the piston rod and coupled with the elongate pump barrel. The Example can include a downward opening air intake passage, located away from the rod seal, in fluid communication with a top of the piston.

Example 2 can include, or can optionally be combined with the subject matter of Example 1, wherein the head is to fit valves of two different sizes.

Example 3 can include, or can optionally be combined with the subject matter of the preceding examples, wherein the elongate pump barrel is an inner conduit and comprising an elongate hollow outer conduit, with the inner conduit disposed in the elongate hollow outer conduit, with the external conduit in fluid communication with an elongate hollow outer conduit chamber of the elongate hollow outer conduit.

Example 4 can include, or can optionally be combined with the subject matter of the preceding examples, comprising a gauge housing coupled to the elongate pump barrel; and a gauge connected to the gauge housing.

Example 5 can include, or can optionally be combined with the subject matter of the preceding examples, wherein at least one fastener couples the gauge housing to the pump barrel, and is disposed between the gauge and the pump barrel, internal to the gauge housing.

Example 6 can include, or can optionally be combined with the subject matter of the preceding examples, wherein the gauge is positioned to interfere with a tool access path to the at least one fastener.

Example 7 can include, or can optionally be combined with the subject matter of the preceding examples, wherein the elongate pump barrel defines a piston chamber inlet, and the gauge housing defines an air intake passage extending from a gauge housing inlet in the gauge housing to the piston chamber inlet.

Example 8 can include, or can optionally be combined with the subject matter of the preceding examples, wherein the gauge housing inlet is disposed on a bottom of the gauge housing.

Example 9 can include, or can optionally be combined with the subject matter of the preceding examples, comprising a first ball valve coupled to the piston to pass air from the piston chamber inlet to the elongate hollow piston chamber.

Example 10 can include, or can optionally be combined with the subject matter of the preceding examples, wherein a first ball valve seat is below a first ball valve ball.

Example 11 can include, or can optionally be combined with the subject matter of the preceding examples, comprising a first ball valve inlet passage extending transverse to the length of the elongate pump housing.

Example 12 can include, or can optionally be combined with the subject matter of the preceding examples, comprising a first ball valve outlet passage extending parallel the length of the elongate pump housing.

Example 13 can include, or can optionally be combined with the subject matter of the preceding examples, wherein the first ball valve outlet passage is one of a pair of outlet passages extending on two sides of the first ball valve inlet passage.

Example 14 can include, or can optionally be combined with the subject matter of the preceding examples, wherein the gauge is fixed to the gauge housing with a snap ring.

Example 15 can include, or can optionally be combined with the subject matter of the preceding examples, wherein the gauge housing defines a counterbore, with the gauge disposed in the counterbore.

Example 16 can include, or can optionally be combined with the subject matter of the preceding examples, wherein gauge disposed entirely in the counterbore.

Example 17 can include, or can optionally be combined with the subject matter of the preceding examples, comprising a transparent gauge cover disposed between the snap ring and the gauge housing.

Example 18 can include, or can optionally be combined with the subject matter of the preceding examples, comprising a rubber piston rod seal disposed around the piston rod.

Example 19 can include, or can optionally be combined with the subject matter of the preceding examples, wherein the piston rod seal is disposed inside the gauge housing, under a top portion of the gauge housing, proximal the piston rod opening.

Example 20 can include, or can optionally be combined with the subject matter of the preceding examples, wherein a piston chamber inlet is disposed on a bottom side of the gauge housing, in fluid communication with the elongate hollow piston chamber.

Example 21 can include, or can optionally be combined with the subject matter of the preceding examples, wherein the gauge housing is coupled to a top of the conduit and defines a piston rod opening sized to conform to the piston rod, the piston rod opening being of a diameter that is smaller than a piston diameter of the piston.

Example 22 can include, or can optionally be combined with the subject matter of the preceding examples, wherein the external conduit is coupled to a bottom of the gauge housing, and extends away from the gauge housing a length that is less than a portion of the length of the elongate pump barrel extending below the gauge housing.

Example 23 can include, or can optionally be combined with the subject matter of the preceding examples, wherein the pump barrel includes a gauge flange.

Example 24 can include, or can optionally be combined with the subject matter of the preceding examples, wherein a fastener for a proximal end of the external conduit is recessed in the gauge flange.

Example 25 can include, or can optionally be combined with the subject matter of the preceding examples, wherein a bottom of the gauge housing abuts a top of the gauge flange.

Example 26 can include, or can optionally be combined with the subject matter of the preceding examples, wherein the gauge flange includes at least one lanyard opening.

Example 27 can include, or can optionally be combined with the subject matter of the preceding examples, wherein the at least one lanyard opening is a slot and where the gauge housing is to extend over the slot opening to close the slot.

Example 28 can include, or can optionally be combined with the subject matter of the preceding examples, wherein the at least one lanyard opening is sized to pass a cable.

Example 29 can include, or can optionally be combined with the subject matter of the preceding examples, wherein a fastener for a proximal end of the external conduit is recessed in the gauge flange.

Example 30 can include, or can optionally be combined with the subject matter of the preceding examples, wherein the gauge housing defines an outlet pressure passage extending from a gauge inlet to an outer conduit outlet of the elongate hollow outer conduit.

Example 31 can include, or can optionally be combined with the subject matter of the preceding examples, wherein an exterior of the elongate hollow outer conduit comprises an exterior of the apparatus.

Example 32 can include, or can optionally be combined with the subject matter of the preceding examples, comprising a dessicant disposed between the inner conduit and the outer conduit.

Example 33 can include, or can optionally be combined with the subject matter of the preceding examples, wherein the dessicant is disposed in a replaceable cartridge that is annular and surrounds the elongate pump barrel.

Example 34 can include, or can optionally be combined with the subject matter of the preceding examples, wherein the conduit is threaded, to threadingly couple with a cap defining an opening sized to conform to the piston rod.

Example 35 can include, or can optionally be combined with the subject matter of the preceding examples, comprising a second ball valve coupled to the elongate piston chamber to pass air from the elongate hollow piston chamber to the external conduit.

Example 36 can include, or can optionally be combined with the subject matter of the preceding examples, wherein a second ball valve seat is above a second ball valve ball.

Example 37 can include, or can optionally be combined with the subject matter of the preceding examples, comprising a second ball valve inlet passage extending transverse to the length of the elongate pump housing.

Example 38 can include, or can optionally be combined with the subject matter of the preceding examples, comprising a second ball valve outlet passage extending parallel the length of the elongate pump housing.

Example 39 can include, or can optionally be combined with the subject matter of the preceding examples, wherein the second ball valve outlet passage is one of a pair of outlet passages extending on two sides of the second ball valve inlet passage.

Example 40 can include, or can optionally be combined with the subject matter of the preceding examples, wherein the outlet passage defines a catch basin to catch debris.

Example 41 can include, or can optionally be combined with the subject matter of the preceding examples, wherein the head includes a relief sized to fit a box end wrench only as wide as a cone wrench.

Example 42 can include, or can optionally be combined with the subject matter of the preceding examples, comprising an elongate pump barrel extending along a length and defining an elongate hollow piston chamber. The Example can include a piston slidably movable within the piston chamber to compress air within the piston chamber. The Example can include a piston rod connected to the piston. The Example can include a handle connected to the piston rod to reciprocally slide the piston in the piston chamber. The Example can include an external conduit coupled with the elongate pump barrel. The Example can include a head connected in fluid communication with the conduit and adapted to be releasably connected in fluid communication with an inflatable object to transfer compressed air from the piston chamber to the inflatable object. The Example can include a piston rod seal disposed around the piston rod and coupled with the elongate pump barrel. The Example can include an air intake passage, located away from the rod seal, in fluid communication with a top of the piston. The Example can include a gauge housing coupled to the elongate pump barrel. The Example can include a gauge connected to the gauge housing.

Example 43 can include, or can optionally be combined with the subject matter of the preceding examples, wherein at least one fastener couples the gauge housing to the pump barrel, and is disposed between the gauge and the pump barrel, internal to the gauge housing.

Example 44 can include, or can optionally be combined with the subject matter of the preceding examples, wherein the gauge is positioned to interfere with a tool access path to the at least one fastener.

Example 45 can include, or can optionally be combined with the subject matter of the preceding examples, coupled with a rack including a plurality of rack members, wherein at least one of the rack members includes an elongate portion that defines a shape, with a sheet affixed to the elongate portion to fill the shape to interfere with passage of a bicycle lock through the shape.

Example 46 can include, or can optionally be combined with the subject matter of the preceding examples, wherein the shape is an inverted U-shape.

Example 47 can include, or can optionally be combined with the subject matter of the preceding examples, wherein two ends the elongate portion are affixed to a substrate.

Example 48 can include, or can optionally be combined with the subject matter of the preceding examples, wherein each of the plurality of rack members defines an inverted U-shape with a first respective end of each of the rack members coupled to a first strut that extends transverse to the U-shape, and with a second respective end of each of the rack members coupled to a second strut extending parallel the first strut.

Example 49 can include, or can optionally be combined with the subject matter of the preceding examples, comprising forming an elongate pump barrel extending along a length to define an elongate hollow piston chamber. The Example can include disposing a piston in the piston chamber slideable for compressing air within the piston chamber. The Example can include coupling a piston rod to the piston, and a handle connected to the piston rod for reciprocally sliding the piston in the piston chamber. The Example can include coupling an external conduit to the elongate pump barrel. The Example can include coupling a head in fluid communication with the conduit for releasably connecting in fluid communication with an inflatable object and transferring compressed air from the piston chamber to the inflatable object. The Example can include affixing a piston rod seal, around the piston rode, to the elongate pump barrel. The Example can include forming a downward opening air intake passage, away from the rod seal and in fluid communication with a top of the piston.

Example 50 can include, or can optionally be combined with the subject matter of the preceding examples, comprising coupling the external conduit to a gauge housing that is coupled to the elongate pump barrel, wherein forming the downward opening air intake passage includes forming the downward opening air intake passage in a bottom of the gauge housing.

Example 51 can include, or can optionally be combined with the subject matter of the preceding examples, comprising recessing a fastener coupling the external conduit to the gauge housing within the external conduit.

Example 52 can include, or can optionally be combined with the subject matter of the preceding examples, comprising an elongate pump barrel defining an elongate hollow piston chamber, wherein the pump barrel includes a gauge flange, wherein the gauge flange includes at least one lanyard opening. The Example can include a piston slidably movable within the piston chamber to compress air within the piston chamber. The Example can include a piston rod connected to the piston. The Example can include a handle connected to the piston rod to reciprocally slide the piston in the piston chamber. The Example can include an external conduit coupled with the pump barrel. The Example can include a head connected in fluid communication with the conduit and adapted to be releasably connected in fluid communication with an inflatable object to transfer compressed air from the piston chamber to the inflatable object. The Example can include a gauge housing coupled to the elongate pump barrel with a bottom of the gauge housing abutting a top of the gauge flange, the gauge housing including a gauge fitting, wherein the gauge housing is coupled to a top of the conduit and defines a piston rod opening sized to conform to the piston rod, the piston rod opening being of a diameter that is smaller than a piston diameter of the piston, wherein the external conduit is coupled to a bottom of the gauge housing, wherein the at least one lanyard opening is a slot and where the gauge housing is to extend over the slot opening to close the slot. The Example can include a gauge connected to the gauge fitting and fixed to the gauge housing, with at least one fastener coupling the gauge housing to the pump barrel being disposed between the gauge and the gauge housing, internal to the gauge housing, with the gauge positioned to interfere with a tool access path of the at least one fastener. The Example can include a cable extending through the at least one lanyard opening, with a hand tool coupled to the cable below the gauge flange, and a terminal end portion coupled to the cable above the gauge flange, the terminal end being sized to resist passage through the lanyard opening.

Example 53 can include, or can optionally be combined with the subject matter of the preceding examples, comprising a base coupled to the pump elongate pump and including a plurality of anchor bores to couple with floor anchors.

Example 54 can include, or can optionally be combined with the subject matter of the preceding examples, comprising forming an elongate pump barrel extending along a length to define an elongate hollow piston chamber. The Example can include disposing a piston in the piston chamber slideable for compressing air within the piston chamber. The Example can include coupling a piston rod to the piston, and a handle connected to the piston rod for reciprocally sliding the piston in the piston chamber. The Example can include coupling an external conduit to the elongate pump barrel. The Example can include coupling a head in fluid communication with the conduit for releasably connecting in fluid communication with an inflatable object and transferring compressed air from the piston chamber to the inflatable object. The Example can include coupling a gauge housing to the elongate conduit, the gauge housing including a gauge fitting. The Example can include coupling a gauge to the gauge fitting. The Example can include fixing the gauge to the gauge housing with at least one fastener under the gauge between the gauge and the pump barrel, internal to the gauge housing, with the gauge positioned to interfere with a tool access path to the at least one fastener.

Example 55 can include, or can optionally be combined with the subject matter of the preceding examples, comprising coupling the external conduit to the gauge housing before coupling the gauge housing to the elongate conduit.

Example 56 can include, or can optionally be combined with the subject matter of the preceding examples, comprising recessing a fastener coupling the external conduit to the gauge housing within the external conduit.

The above detailed description includes references to the accompanying drawings, which form a part of the detailed description. The drawings show, by way of illustration, specific embodiments in that may be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein," Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is to allow the reader to quickly ascertain the nature of the technical disclosure, for example, to comply with 37 C.F.R. § 1.72(b) in the United States of America. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the embodiments should be determined with reference to the appended claims, along with the full scope of equivalents to which such claims are entitled.

The Abstract is provided to comply with 37 C.F.R., Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A manually operable air pump, comprising:

a pump barrel defining an elongate hollow piston chamber, wherein the pump barrel includes an inlet for supplying air to the piston chamber and an outlet for discharging air from the piston chamber;

a slideable piston in the piston chamber for discharging air from the piston chamber through the outlet;

an external discharge conduit coupled to the pump barrel via a discharge conduit mounting structure, wherein the discharge conduit mounting structure includes an air intake arrangement in communication with the inlet of the pump barrel and an air discharge arrangement interposed between the outlet of the pump barrel and the external discharge conduit, wherein, in use, the air pump is adapted to be positioned on an upwardly facing supporting surface, and wherein the air intake arrangement includes an air inlet opening that faces downwardly toward the supporting surface during use of the air pump;

wherein the discharge conduit mounting structure comprises a housing secured to the pump barrel, wherein the housing defines a recess;

a pressure gauge mounted to the housing within the recess of the housing via a mounting ring; and a housing mounting member that extends outwardly from the pump barrel, wherein the housing is secured to the housing mounting member via one or more fasteners that extend between and interconnect the housing to the housing mounting member, wherein each fastener comprises a head and a threaded shaft, wherein the shaft extends through a passage in the housing into engagement with the housing mounting member, and wherein the head of each fastener is located within the recess.

2. The air pump of claim 1, wherein the pressure gauge is positioned within the housing and is configured to overlie the heads of the one or more fasteners so as to prevent access to the heads of the one or more fasteners from the exterior of the housing.

3. The air pump of claim 2, wherein the pressure gauge is secured within the recess of the housing via the mounting ring.

4. A manually operable air pump that is adapted to be positioned on an upwardly facing supporting surface in use, comprising:

a pump barrel defining an elongate hollow piston chamber, wherein the pump barrel includes an inlet for supplying air to the piston chamber and an outlet for discharging air from the piston chamber;

a slideable piston in the piston chamber for discharging air from the piston chamber through the outlet;

a gauge housing secured to and extending outwardly from the pump barrel, wherein the gauge housing defines a downwardly facing surface and an upwardly facing recess;

a pressure gauge positioned within the upwardly facing recess of the gauge housing;

an external discharge conduit coupled to the gauge housing, wherein the external discharge conduit communicates with the pump barrel outlet via a discharge passage in the gauge housing;

an air intake arrangement that extends upwardly from the downwardly facing surface of the gauge housing and that communicates with the pump barrel inlet via an intake passage in the gauge housing; and a housing mounting member that extends outwardly from the pump barrel, wherein the gauge housing is secured to the housing mounting member via one or more fasteners that extend between and interconnect the housing to the housing mounting member, wherein each fastener comprises a head and a threaded shaft, wherein the shaft extends through a passage in the housing into engagement with the housing mounting member, and wherein the head of each fastener is located within the recess.

5. The air pump of claim 4, wherein the pressure gauge is positioned within the housing and is configured to overlie the heads of the one or more fasteners so as to prevent access to the heads of the one or more fasteners from the exterior of the housing.

6. The air pump of claim 4, wherein the gauge housing includes a common passage with which both the discharge conduit and the pressure gauge are engaged, and wherein the intake passage in the gauge housing extends between the common passage and the inlet of the pump barrel.

* * * * *